US007313518B2

(12) United States Patent
Scalart et al.

(10) Patent No.: US 7,313,518 B2
(45) Date of Patent: Dec. 25, 2007

(54) NOISE REDUCTION METHOD AND DEVICE USING TWO PASS FILTERING

(75) Inventors: Pascal Scalart, Trebeurden (FR); Claude Marro, Plouguiel (FR); Laurent Mauuary, Lannion (FR)

(73) Assignee: France Telecom, Paris (FR)

( * ) Notice: Subject to any disclaimer, the term of this patent is extended or adjusted under 35 U.S.C. 154(b) by 890 days.

(21) Appl. No.: 10/466,816

(22) PCT Filed: Nov. 19, 2001

(86) PCT No.: PCT/FR01/03624

§ 371 (c)(1),
(2), (4) Date: Jul. 22, 2003

(87) PCT Pub. No.: WO02/061731

PCT Pub. Date: Aug. 8, 2002

(65) Prior Publication Data

US 2004/0064307 A1 Apr. 1, 2004

(30) Foreign Application Priority Data

Jan. 30, 2001 (FR) ..... 01 01220

(51) Int. Cl.
*G10L 21/02* (2006.01)

(52) U.S. Cl. ..... 704/226

(58) Field of Classification Search ..... 704/205, 704/226, 214

See application file for complete search history.

(56) References Cited

U.S. PATENT DOCUMENTS 5,630,013 A * 5/1997 Suzuki et al. ..... 704/216
5,680,393 A * 10/1997 Bourmeyster et al. ..... 370/286
5,963,898 A * 10/1999 Navarro et al. ..... 704/220
5,999,561 A * 12/1999 Naden et al. ..... 375/142
6,549,586 B2 * 4/2003 Gustafsson et al. ..... 375/285
6,792,405 B2 * 9/2004 Cox et al. ..... 704/236

FOREIGN PATENT DOCUMENTS

EP 0 730 262 A2 9/1996
EP 0 856 833 A2 8/1998
EP 0 918 317 B1 8/2003

OTHER PUBLICATIONS

Sim et al., "A Parametric Formulation of the Generalized Spectral Subtraction Method," *IEEE Transactions on Speech and Audio Processing*, 6 (4), 328-336 (Jul. 1, 1998).
International Search Report established for PCT/FR01/03624.

* cited by examiner

*Primary Examiner*—Abul K. Azad
(74) *Attorney, Agent, or Firm*—Drinker Biddle & Reath LLP

(57) ABSTRACT

The device calculates a first frequency-dependent useful signal level estimator for the frame. The transfer function of a first noise-reducing filter is determined on the basis of the first useful signal level estimator and of a frequency-dependent noise level estimator. A second frequency-dependent useful signal level estimator for the frame is then calculated by combining the spectrum of the input signal and the transfer function of the first noise-reducing filter. The transfer function of a second noise-reducing filter is determined on the basis of the second useful signal level estimator and of the noise level estimator. The latter transfer function is used in a frame filtering operation to produce a signal with reduced noise.

18 Claims, 3 Drawing Sheets

NOISE REDUCTION METHOD AND DEVICE USING TWO PASS FILTERING

BACKGROUND OF THE INVENTION

The present invention relates to signal processing techniques used to reduce the noise level present in an input signal.

An important field of application is that of audio signal processing (speech or music), including in a nonlimiting way:

- teleconferencing and videoconferencing in a noisy environment (in a dedicated room or even from multimedia computers, etc.);
- telephony: processing at terminals, fixed or portable and/or in the transport networks;
- hands-free terminals, in particular office, vehicle or portable terminals;
- sound pick-up in public places (station, airport, etc.);
- hands-free sound pick-up in vehicles;
- robust speech recognition in an acoustic environment;
- sound pick-up for cinema and the media (radio, television, for example for sports journalism or concerts, etc.).

The invention can also be applied to any field in which useful information needs to be extracted from a noisy observation. In particular, the following fields can be cited: submarine imaging, submarine remote sensing, biomedical signal processing (EEG, ECG, biomedical imaging, etc.).

A characteristic problem of sound pick-up concerns the acoustic environment in which the sound pick-up microphone is placed and more specifically the fact that, because it is impossible to fully control this environment, an interfering signal (referred to as noise) is also present within the observation signal.

To improve the quality of the signal, noise reduction systems are developed with the aim of extracting the useful information by performing processing on the noisy observation signal. When the audio signal is a speech signal transmitted from a long distance away, these systems can be used to increase its intelligibility and to reduce the strain on the correspondent. In addition to these applications of spoken communication, improvement in speech signal quality also turns out to be useful for voice recognition, the performance of which is greatly impaired when the user is in a noisy environment.

The choice of a signal processing technique for carrying out the noise reduction operation depends first on the number of observations available at the input of the process. In the present description, we will consider the case in which only one observation signal is available. The noise reduction methods adapted for this single-capture problematic rely mainly on signal processing techniques such as adaptive filtering with time advance/delay, parametric Kalman filtering, or even filtering by short-time spectral modification.

The latter family (filtering by short-time spectral modification) combines practically all the solutions used in industrial equipment due to the simplicity of concepts involved and the wide availability of basic tools (for example the discrete Fourier transform) required to program them. However, the rapid advance of these noise reduction techniques relies heavily on the possibility of easily performing these processing operations in real time on a signal processing processor, without introducing major distortions on the signal available at the output of the processing operation. In the methods of this family, the processing most often only consists in estimating a transfer function of a noise-reducing filter, then in performing the filtering based on a multiplication in the spectral domain, which enables the noise reduction by short-time spectral attenuation to be carried out, with processing by blocks.

The noisy observation signal, arising from the mixing of the desired signal s(n) and the interfering noise b(n), is denoted x(n), where n denotes the time index in discrete time. The choice of a representation in discrete time is related to an implementation directed toward the digital processing of the signal, but it will be noted that the methods described above apply also to continuous time signals. The signal is analyzed in successive segments or frames of index k of constant length. Notations currently used for representations in the discrete time and frequency domains are:

- X(k,f): Fourier transform (f is the frequency index) of the k-th frame (k is the frame index) of the analyzed signal x(n);
- S(k,f): Fourier transform of the k-th frame of the desired signal s(n);
- $\hat{v}$: estimation of a quantity (in the time or frequency domain) v; for example $\hat{S}(k,f)$ is the estimation of the Fourier transform of the desired signal;
- $\gamma_{uu}(f)$: power spectral density (PSD) of a signal u(n).

In most noise reduction techniques, the noisy signal x(n) undergoes filtering in the frequency domain to produce a useful estimated signal $\hat{s}(n)$ which is as close as possible to the original signal s(n) free from any interference. As indicated previously, this filtering operation consists in reducing each frequency component f of the noisy signal given the estimated signal-to-noise ratio (SNR) in this component. This SNR, dependent on the frequency f, is denoted here as η(k,f) for the frame k.

For each of the frames, the signal is first multiplied by a weighting window for improving the later estimation of the spectral quantities required to calculate the noise-reducing filter. Each frame thus windowed is then analyzed in the spectral domain (generally using the discrete Fourier transform in its fast version). This operation is called short-time Fourier transform (STFT). This frequency-domain representation X(k,f) of the observed signal can be used to simultaneously estimate the transfer function H(k,f) of the noise-reducing filter, and to apply this filter in the spectral domain by simple multiplication of this transfer function by the short-time spectrum of the noisy signal, that is:

$$\hat{S}(k,f)=H(k,f).X(k,f) \tag{1}$$

The signal thus obtained is then returned to the time domain by simple inverse spectral transform. The denoised signal is generally synthesized by a technique of overlapping and adding of blocks (OLA, "overlap-add") or a technique of saving of blocks (OLS, "overlap-save"). This operation for reconstructing the signal in the time domain is called inverse short-time Fourier transform (ISTFT).

A detailed description of short-time spectral attenuation methods will be found in the following references: J. S. Lim, A. V. Oppenheim, "Enhancement and bandwidth compression of noisy speech", Proceedings of the IEEE, vol. 67, pages 1586-1604, 1979; and R. E. Crochiere, L. R. Rabiner, "Multirate digital signal processing", Prentice Hall, 1983.

The main tasks performed by such a noise reduction system are:

- voice activity detection (VAD);
- estimation of the power spectral density (PSD) of noise during instants of voice inactivity;
- application of a short-time spectral attenuation evaluated based on a rule for suppressing spectral components of noise;

synthesis of the processed signal based on an OLS or OLA type technique.

The choice of the rule for suppressing noise components is important since it determines the quality of the transmitted signal. These suppression rules modify in general only the amplitude $|X(k,f)|$ of the spectral components of the noisy signal, and not their phase. In general, the following assumptions are made:

- the noise and useful signal are statistically decorrelated;
- the useful noise is intermittent (presence of periods of silence in which the noise can be estimated);
- the human ear is not sensitive to the phase of the signal (see D. L. Wang, J. S. Lim, "The unimportance of phase in speech enhancement", IEEE Trans. on ASSP, vol. 30, No. 4, pp. 679-681, 1982).

The short-time spectral attenuation H(k,f) applied to the observation signal X(k,f) on the frame of index k at the frequency-domain component f, is generally determined based on the estimation of the local signal-to-noise ratio $\eta(k,f)$. A characteristic common to all suppression rules is their asymptotic behavior, given by:

$$H(k,f)\approx 1 \text{ for } \eta(k,f)>>1$$

$$H(k,f)\approx 0 \text{ for } \eta(k,f)<<1 \tag{2}$$

The suppression rules currently employed are:

- power spectral subtraction (see the above-mentioned article by J. S. Lim and A. V. Oppenheim), for which the transfer function H(k,f) of the noise-reducing filter is expressed as:

$$H(k,f)=\sqrt{\frac{\gamma_{ss}(k,f)}{\gamma_{bb}(k,f)+\gamma_{ss}(k,f)}} \tag{3}$$

- amplitude spectral subtraction (see S. F. Boll, "Suppression of acoustic noise in speech using spectral subtraction", IEEE Trans. on Audio, Speech and Signal Processing, vol. 27, No. 2, pp. 113-120, April 1979), for which the transfer function H(k,f) is expressed as:

$$H(k,f)=1-\sqrt{\frac{\gamma_{bb}(k,f)}{\gamma_{bb}(k,f)+\gamma_{ss}(k,f)}} \tag{4}$$

- direct application of the Wiener filter (see the abovementioned article by J. S. Lim and A. V. Oppenheim), for which the transfer function H(k,f) is expressed as:

$$H(k,f)=\frac{\gamma_{ss}(k,f)}{\gamma_{bb}(k,f)+\gamma_{ss}(k,f)} \tag{5}$$

In these expressions, $\gamma_{ss}(k,f)$ and $\gamma_{bb}(k,f)$ represent the power spectral densities, respectively, of the useful signal and of the noise present within the frequency-domain component f of the observation signal X(k,f) on the frame of index k.

From expressions (3)-(5), according to the local signal-to-noise ratio measured on a given frequency-domain component f, it is possible to study the behavior of the spectral attenuation applied to the noisy signal. It is noted that all the rules give rise to an identical attenuation when the local signal-to-noise ratio is high. The power subtraction rule is optimal in the sense of maximum likelihood for Gaussian models (see O. Cappé, "Elimination of the musical noise phenomenon with the Ephraim and Malah noise suppressor", IEEE Trans. on Speech and Audio Processing, vol. 2, No. 2, pp 345-349, April 1994). But it is the one for which the noise power remains the greatest at the output of the processing. For all the suppression rules, it is noted that a small variation in the local signal-to-noise ratio around the cut-off value is sufficient to bring about a change from the case of total attenuation ($H(k,f)\approx 0$) to the case of a negligible spectral modification ($H(k,f)\approx 1$).

The latter property constitutes one of the causes of the phenomenon known as "musical noise". Indeed, ambient noise, characterized both by deterministic and random components, can be characterized only during periods of voice inactivity. Because of the presence of these random components, there are very marked variations between the real contribution of a frequency-domain component f of noise during periods of voice activity and its average estimation carried out over several frames during instants of voice inactivity. Because of this difference, the estimation of the local signal-to-noise ratio can fluctuate around the cut-off level that is, therefore, it can produce, at the output of the processing, spectral components which appear then disappear, and for which the average lifetime does not statistically exceed the order of magnitude of the analysis window considered. Generalization of this behavior over the whole passband introduces a residual noise that is audible and irritating, known as "musical noise".

There are many studies devoted to reducing the effect of this noise. The recommended solutions are developed along various lines:

- averaging of short-time estimations (see above-mentioned article by S. F. Boll);
- overestimation of the noise power spectrum (see M. Berouti et al, "Enhancement of speech corrupted by acoustic noise", Int. Conf. on Speech, Signal Processing, pp. 208-211, 1979; and P. Lockwood, J. Boudy, "Experiments with a non-linear spectral subtractor, hidden Markov models and the projection for robust speech recognition in cars", Proc. of EUSIPCO'91, pp. 79-82, 1991);
- tracking the minima of the noise spectral density (see R. Martin, "Spectral subtraction based on minimum statistics", in Signal Processing VII: Theories and Applications, EUSIPCO'94, pp. 1182-1185, September 1994).

There have also been many studies on establishing new suppression rules based on statistical models of signals of speech and of additive noise. These studies have led to the introduction of new "soft decision" algorithms since they have an additional degree of freedom compared to conventional methods (see R. J. Mac Aulay, M. L. Malpass, "Speech enhancement using a soft-decision noise suppression filter", IEEE trans. on Audio, Speech and Signal Processing, vol. 28, No. 2, pp. 138-145, April 1980, Y. Ephraim, D. Malah, "Speech enhancement using optimal non-linear spectral amplitude estimation", Int. Conf. on Speech, Signal Processing, pp. 1118-1121, 1983, Y. Ephraim, D. Malha, "Speech enhancement using a minimum mean square error short-time spectral amplitude estimator", IEEE Trans. on ASSP, vol. 32, No. 6, pp. 1109-1121, 1984).

The abovementioned short-time spectral modification rules have the following characteristics:

the calculation of short-time spectral attenuation relies on the estimation of the signal-to-noise ratio on each of the spectral components, equations (3)-(5) each including the quantity:

$$\eta(k, f) = \frac{\gamma_{ss}(k, f)}{\gamma_{bb}(k, f)} \tag{6}$$

Thus, the performance of the noise reduction technique (distortions, effective reduction in noise level) are governed by the pertinence of this estimator of the signal-to-noise ratio.

These techniques are based on blockwise processing (with the possibility of overlapping between the successive blocks) which consists in filtering all the samples of a given frame, present at the input of the noise reduction device, by a single spectral attenuation. This property lies in the fact that the filter is applied by a multiplication in the spectral domain. This is particularly restricting when the signal present on the current frame does not comply with the second order stationarity assumptions, for example in the case of a start or end of a word, or even in the case of a mixed voiced/unvoiced frame.

The multiplication carried out in the spectral domain corresponds in reality to a cyclic convolution operation. In practice, to avoid distortions, the operation attempted is a linear convolution, which requires both adding a certain number of zero samples to each input frame (technique referred to as "zero padding") and performing additional processing aimed at limiting the time-domain support of the impulse response of the noise-reducing filter. Satisfying the time-domain convolution constraint thus necessarily increases the order of the spectral transform and, consequently, the arithmetic complexity of the noise-reducing processing. The technique used most to limit the time-domain support of the impulse response of the noise-reducing filter consists in introducing a constraint in the time domain, which requires (i) a first "inverse" spectral transformation for obtaining the impulse response h(k,n) based on the knowledge of the transfer function of the filter H(k,f), (ii) a limitation of the number of points of this impulse response, leading to a truncated time-domain filter h'(k,n), then (iii) a second "direct" spectral transformation for obtaining the modified transfer function H'(k,f) based on the truncated impulse response h'(k,n).

In practice, each analysis frame is multiplied by an analysis window w(n) before performing the spectral transform operation. When the noise-reducing filter is of all-pass type (that is H(k,f)≈1, ∀f), the analysis window must satisfy the following condition $$\sum_k w(n - k \cdot D) = 1 \tag{7}$$

if it is desired that the condition of perfect reconstruction is satisfied. In this equation, the parameter D represents the shift (in number of samples) between two successive analysis frames. On the other hand, the choice of the weighting window w(n) (typically of Hanning, Hamming, Blackman, etc. type) determines the width of the main lobe of W(f) and the amplitude of the secondary lobes (relative to that of the main lobe). If the main lobe is broad, the fast transitions of the transform of the original signal are very badly approximated. If the relative amplitude of the secondary lobes is large, the approximation obtained has irritating oscillations, especially around the discontinuities. It is therefore difficult to satisfy both the pertinent spectral analysis requirement (choice of the width of the main lobe, and of the amplitude of the side lobes) and the requirement of small delay introduced by the noise reduction filtering process (time shift between the signal at the input and at the output of the processing). Satisfying the second requirement leads to using successive frames without any overlap and therefore a rectangular-type analysis window, which does not result in performing a pertinent spectral analysis. The only way to satisfy both these requirements at the same time is to perform a spectral analysis based on a first spectral transformation carried out on a frame weighted by an appropriate analysis window (to perform a good spectral estimation), and in parallel to perform a second spectral transformation on unwindowed data (in order to carry out the convolution operation by spectral multiplication). In practice, such a technique proves to be far too costly in terms of arithmetic complexity.

EP-A-0 710 947 disloses a noise reduction device coupled to an echo canceler. The noise reduction is carried out by blockwise filtering in the time domain, by means of an impulse response obtained by inverse Fourier transformation of the transfer function H(k,f) estimated according to the signal-to-noise ratio during the spectral analysis.

A primary object of the present invention is to improve the performance of the noise reduction methods.

SUMMARY OF THE INVENTION

The invention thus proposes a method for reducing noise in successive frames of an input signal, comprising the following steps for at least some of the frames:

- calculating a spectrum of the input signal by transformation to the frequency domain;
- obtaining a frequency-dependent noise level estimator;
- calculating a first frequency-dependent useful signal level estimator for the frame;
- calculating the transfer function of a first noise-reducing filter on the basis of the first useful signal level estimator and of the noise level estimator;
- calculating a second frequency-dependent useful signal level estimator for the frame, by combining the spectrum of the input signal and the transfer function of the first noise-reducing filter;
- calculating the transfer function of a second noise-reducing filter on the basis of the second useful signal level estimator and of the noise level estimator; and
- using the transfer function of the second noise-reducing filter in a frame filtering operation to produce a signal with reduced noise.

The noise and useful signal levels that are estimated are typically PSDs, or more generally quantities correlated with these PSDs.

The calculation in two passes, the particular aspect of which resides in a faster updating of the PSD of the useful signal $\gamma_{ss}(k,f)$, results in the second noise-reducing filter gaining two significant advantages over the previous methods. First, there is a faster tracking of non-stationarities of the useful signal, in particular during faster variations of its temporal envelope (for example attacks or extinctions for some speech signal during a silence/speech transition). Secondly, the noise-reducing filter is better estimated, which results in an improvement of performance of the method (more pronounced noise reduction and reduced degradation of the useful signal).

The method can be generalized to the case in which more than two passes are carried out. Based on the p-th transfer function obtained ($p \geqq 2$), the useful signal level estimator is then recalculated, and a (p+1)-th transfer function is re-evaluated for the noise reduction. The above definition of the method applies also to cases in which P>2 passes are made: the "first useful signal level estimator" according to this definition need simply be considered as the one obtained during the (P−1)-th pass. In practice, satisfactory performance of the method is observed with P=2.

In one advantageous embodiment of the method, the calculation of the spectrum consists of a weighting of the input signal frame by a windowing function and a transformation of the weighted frame to the frequency domain, the windowing function being dissymmetric so as to apply a stronger weighting on the more recent half of the frame than on the less recent half of the frame.

The choice of such a windowing function means that the weight of the spectral estimation can be concentrated toward the most recent samples, while providing for a window having good spectral properties (controlled increase of the secondary lobes). This enables signal variations to be tracked rapidly. It is to be noted that this mode of calculation of the spectrum for the frequency-based analysis can also be applied when the estimation of the transfer function of the noise-reducing filter is performed in only one pass.

The method can be used when the input signal is block-wise filtered in the frequency domain, by the above-mentioned short-time spectral attenuation methods. The denoised signal is then produced in the form of its spectral components $\hat{S}(k,f)$, which can be exploited directly (for example in a coding application or speech recognition application) or transformed to the time domain to explicitly obtain the signal $\hat{s}(n)$.

However, in one preferred embodiment of the method, a noise-reducing filter impulse response is determined for the current frame based on a transformation to the time domain of the transfer function of the second noise-reducing filter, and the filtering operation on the frame in the time domain is carried out by means of the impulse response determined for said frame.

Advantageously, the determination of the noise-reducing filter impulse response for the current frame then comprises the following steps:

- transforming to the time domain the transfer function of the second noise-reducing filter to obtain a first impulse response; and
- truncating the first impulse response to a truncation length corresponding to a number of samples substantially smaller (typically at least five times smaller) than the number of points of the transformation to the time domain.

This limitation in the time-domain support of the noise-reducing filter provides a two-fold advantage. First, it means that time-domain aliasing problems are avoided (compliance with linear convolution). Secondly, it provides a smoothing effect enabling the effects of a filter that is too aggressive, which could degrade the useful signal, to be avoided. It can be accompanied by a weighting of the impulse response truncated by a windowing function on a number of samples corresponding to the truncation length. It is to be noted that this limitation in the time-domain support of the filter can also be applied when the estimation of the transfer function is performed in a single pass.

When the filtering is performed in the time domain, it is advantageous to subdivide the current frame into several sub-frames and to calculate for each sub-frame an interpolated impulse response based on the noise-reducing filter impulse response determined for the current frame and on the noise-reducing filter impulse response determined for at least one previous frame. The filtering operation of the frame then includes a filtering of the signal of each sub-frame in the time domain in accordance with the interpolated impulse response calculated for said sub-frame.

This processing into subframes results in the possibility of applying a noise-reducing filter varying within the same frame, and therefore well suited to the non-stationarities of the processed signal. In the case of processing a voice signal, this situation is encountered in particular on mixed frames (that is to say those having voiced and unvoiced sounds). It is to be noted that this processing into sub-frames can also be applied when the estimation of the transfer function of the filter is performed in a single pass. Another aspect of the present invention relates to a noise reduction device designed to implement the above method.

BRIEF DESCRIPTION OF THE DRAWINGS

FIGS. 1 to 3 give a representation of a device according to the invention in the form of separate units.

DESCRIPTION OF PREFERRED EMBODIMENTS

In one typical implementation of the method, the signal processing operations are carried out, as normal, by a digital signal processor executing programs for which the various functional modules correspond to the abovementioned units.

Figure 1:
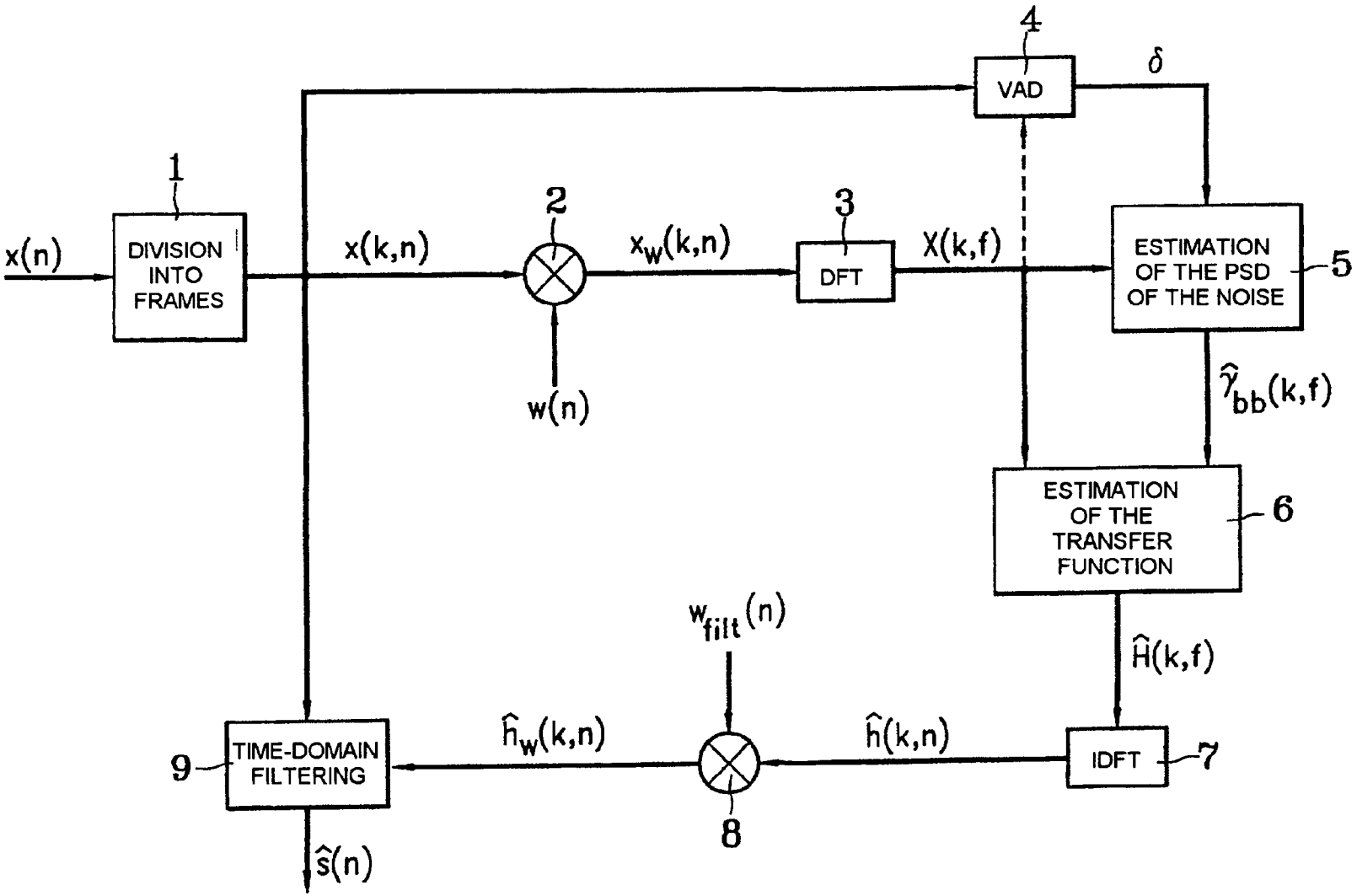
FIG. 1 is a block diagram of a noise reduction device designed to implement the method according to the invention.

With reference to FIG. 1, a noise reduction device according to the invention comprises a unit 1 which distributes the input signal x(n), such as a digital audio signal, into successive frames of length L samples (indexed by an integer k). Each frame of index k is weighted (multiplier 2) by multiplying it by a windowing function w(n), producing the signal $x_w(k,n)=w(n).x(k,n)$ for $0 \leqq n < L$.

The transition to the frequency domain is achieved by applying the discrete Fourier transform (DFT) to the weighted frames $x_w(k,n)$ by means of a unit 3 which delivers the Fourier transform X(k,f) of the current frame.

For the time-frequency domain transitions, and vice versa, involved in the invention, the DFT and the inverse transform to the time domain (IDFT) used downstream if necessary (unit 7) are advantageously a fast Fourier transform (FFT) and inverse fast Fourier transform (IFFT) respectively. Other time-frequency transformations, such as the wavelet transform, can also be used.

A voice activity detection (VAD) unit 4 is used to discriminate the noise-only frames from the speech frames, and delivers a binary voice activity indication δ for the current frame. Any known VAD method can be used, whether it operates in the time domain on the basis of the signal x(k,n) or, as indicated by the dashed line, in the frequency domain on the basis of the signal X(k,f).

The VAD controls the estimation of the PSD of the noise by the unit 5. Thus, for each "noise-only" frame $k_b$ detected by the unit 4 ($\delta=0$), the noise power spectral density $\hat{\gamma}_{bb}(k_b,f)$ is estimated by the following recursive expression:

$$\begin{cases} \hat{\gamma}_{bb}(k_b, f) = \alpha(k_b)\cdot\hat{\gamma}_{bb}(k_b-1, f) + (1-\alpha(k_b))\cdot|X(k_b, f)|^2 \\ \hat{\gamma}_{bb}(k, f) = \hat{\gamma}_{bb}(k_b, f) \end{cases} \quad (10)$$

where $k_b$ is either the current noise frame if $\delta=0$, or the last noise frame if $\delta=1$ (k is detected as useful signal frame), and $\alpha(k_b)$ is a smoothing parameter able to vary over time.

It will be noted that the method of calculation of $\hat{\gamma}_{bb}(k_b,f)$ is not limited to this estimator with exponential smoothing; any other PSD estimator can be used by the unit 5.

Using the spectrum X(k,f) of the current frame and the noise level estimation $\hat{\gamma}_{bb}(k_b,f)$, another unit 6 estimates the transfer function (TF) of the noise-reducing filter $\hat{H}(k,f)$. The unit 7 applies the IDFT to this TF to obtain the corresponding impulse response $\hat{h}(k,n)$.

A windowing function $w_{filt}(n)$ is applied to this impulse response $\hat{h}(k,n)$ by a multiplier 8 to obtain the impulse response $\hat{h}_w(k,n)$ of the time-domain filter of the noise reduction device. The operation carried out by the filtering unit 9 to produce the denoised time-domain signal $\hat{s}(n)$ is, in its principle, a convolution of the input signal with the impulse response $\hat{h}_w(k,n)$ determined for the current frame.

The windowing function $w_{filt}(n)$ has a support that is markedly shorter than the length of a frame. In other words, the impulse response $\hat{h}(k,n)$ resulting from the IDFT is truncated before the weighting by the function $w_{filt}(n)$ is applied to it. As a preference, the truncation length $L_{filt}$, expressed as a number of samples, is at least five times shorter than the length of the frame. It is typically of the order of magnitude of a tenth of this frame length.

The most significant $L_{filt}$ coefficients of the impulse response are the subject of weighting by the window $w_{filt}(n)$, which is for example a Hamming or Hanning window of length $L_{filt}$:

$$\hat{h}_w(k,n)=w_{filt}(n).\hat{h}(k,n) \text{ pour } 0\leqq n<L_{filt} \quad (11)$$

The limitation in the time-domain support of the noise-reducing filter enables time-domain aliasing problems to be avoided, in order to satisfy the linear convolution. It additionally provides smoothing enabling the effects of too aggressive a filter, which effects could degrade the useful signal, to be avoided.

Figure 2:
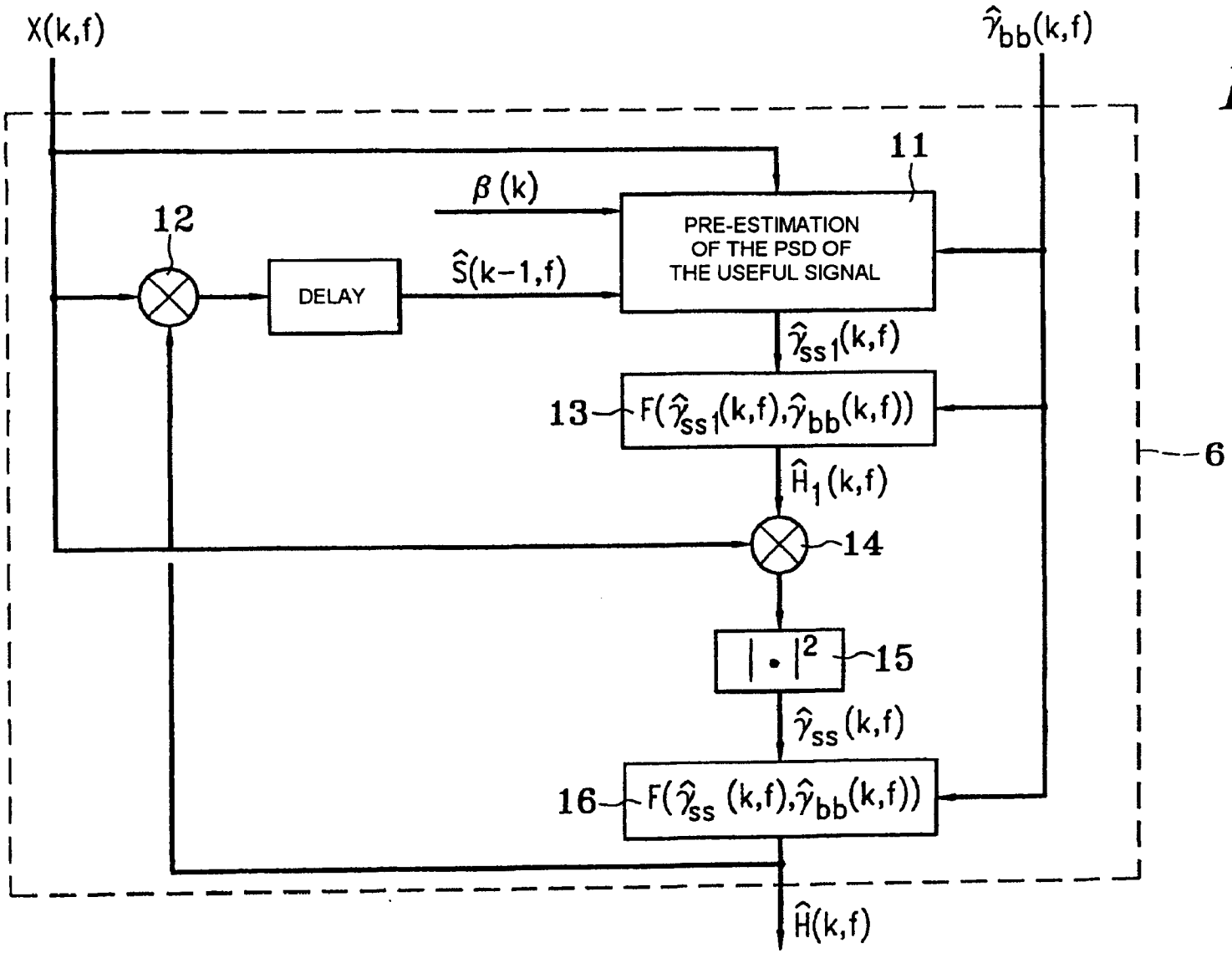
FIG. 2 is a block diagram of a unit for estimating the transfer function of a noise-reducing filter that can be used in a device according to FIG. 1.

FIG. 2 illustrates a preferred organization of the unit 6 for estimating the transfer function H(k,f) of the noise-reducing filter, which depends on the PSD of the noise b(n) and that of the useful signal s(n).

It has been described how the unit 5 can estimate the PSD of the noise $\hat{\gamma}_{bb}(k_b,f)$. But the PSD $\gamma_{ss}(k,f)$ of the useful signal cannot be obtained directly because of the signal and noise being mixed during periods of voice activity. To pre-estimate it, the module 11 of the unit 6 in FIG. 2 uses for example a directed decision estimator (see Y. Ephraim, D. Malha, "Speech enhancement using a minimum mean square error short-time spectral amplitude estimator", IEEE Trans. on ASSP, vol. 32, No. 6, pp. 1109-1121, 1984), in accordance with the following expression:

$$\hat{\gamma}_{ssl}(k,f)=\beta(k).|\hat{S}(k-1,f)|^2+(1-\beta(k)).P[|X(k,f)|^2-\hat{\gamma}_{bb}(k,f)] \quad (12)$$

where $\beta(k)$ is a barycentric parameter able to vary over time and $\hat{S}(k-1,f)$ is the spectrum of the useful signal estimated relative to the preceding frame of index k−1 (for example $\hat{S}(k-1,f)=\hat{H}(k-1,f).X(k-1,f)$, obtained by the multiplier 12 in FIG. 2). The function P provides the thresholding of the quantity $|X(k,f)|^2-\hat{\gamma}_{bb}(k,f)$ which runs the risk of being negative in the event of an estimation error. It is given by:

$$P[z(k, f)] = \begin{cases} z(k, f) & \text{if } z(k, f) > 0 \\ \hat{\gamma}_{bb}(k, f) & \text{otherwise} \end{cases} \quad (13)$$

It is to be noted that the calculation of $\hat{\gamma}_{ssl}(k,f)$ is not limited to this directed decision estimator. Indeed, an exponential smoothing estimator or any other power spectral density estimator can be used.

A pre-estimation of the TF of the noise-reducing filter for the current frame is calculated by the module 13, as a function of the estimated PSDs $\hat{\gamma}_{ssl}(k,f)$ and $\hat{\gamma}_{bb}(k,f)$:

$$\hat{H}_1(k,f)=F(\hat{\gamma}_{ssl}(k,f), \hat{\gamma}_{bb}(k,f)) \quad (14)$$

This module 13 can in particular implement the rule of power spectral subtraction $$\left(F(y, z) = \sqrt{\frac{y}{y+z}} \text{ according to (3)}\right),$$

of amplitude spectral substraction $$\left(F(y, z) = 1 - \sqrt{\frac{z}{y+z}} \text{ according to (4)}\right),$$

or even that of the open loop Wiener filter $$\left(F(y, z) = \frac{y}{y+z} \text{ according to (5)}\right).$$

Usually, the final transfer function of the noise-reducing filter is obtained using equation (14). To improve the performance of the filter, it is proposed to estimate it using an iterative procedure in two passes. The first pass consists of the operations performed by modules 11 to 13.

The transfer function $\hat{H}_1(k,f)$ thus obtained is reused to refine the estimation of the PSD of the useful signal. The unit 6 (multiplier 14 and module 15) calculates, for this, the quantity $\hat{\gamma}_{ss}s(k,f)$ given by:

$$\hat{\gamma}_{ss}(k,f)=|\hat{H}(k,f).X(k,f)|^2 \quad (15)$$

The second pass then consists in, for the module 16, calculating the final estimator $\hat{H}(k,f)$ of the transfer function of the noise-reducing filter based on the refined estimation of the PSD of the useful signal:

$$\hat{H}(k,f)=F(\hat{\gamma}_{ss}(k,f), \hat{\gamma}_{bb}(k,f)) \quad (16)$$

the function F being able to be the same as that used by the module 13.

This calculation in two passes enables a faster update of the PSD of the useful signal $\hat{\gamma}_{ss}(k,f)$ and a better estimation of the filter.

Figure 3:
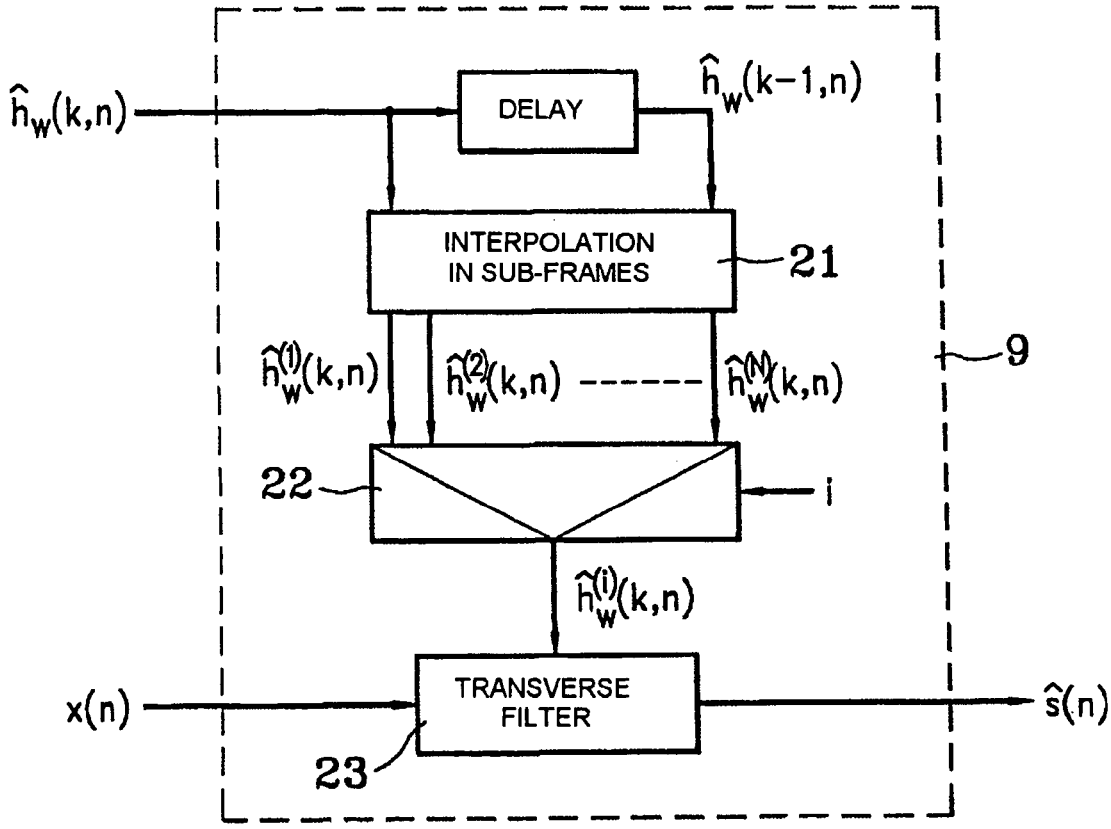
FIG. 3 is a block diagram of a time-domain filtering unit that can be used in a device according to FIG. 1.

FIG. 3 illustrates a preferred organization of the time-domain filtering unit 9, based on a subdivision of the current frame into N sub-frames and thus enabling application of a noise reduction function capable of evolving within the same signal frame.

A module 21 performs an interpolation of the truncated and weighted impulse response $\hat{h}_w(k,n)$ in order to obtain a set of $N \geqq 2$ impulse responses of filters of sub-frames $$\hat{h}_w^{(i)}(k,n)$$

for i progressing from 1 to N.

Filtering based on sub-frames can be implemented using a transverse filter 23 of length $L_{filt}$ the coefficients $$\hat{h}_w^{(i)}(k,n)$$

($0 \leqq n < L_{filt}$, $1 \leqq i \leqq N$) of which are presented in cascade by the selector 22 on the basis of the index i of the current sub-frame. The sub-frames of the signals to be filtered are obtained by a subdivision of the input frame x(k,n). The transverse filter 23 thus calculates the reduced-noise signal $\hat{s}(n)$ by convolution of the input signal x(n) with the coefficients $$\hat{h}_w^{(i)}(k,n)$$

associated with the current sub-frame.

The responses $$\hat{h}_w^{(i)}(k,n)$$

of the sub-frame filters can be calculated by the module 21 as weighted sums of the impulse response $\hat{h}_w(k,n)$ determined for the current frame and of the impulse response $\hat{h}_w(k-1,n)$ determined for the previous frame. When the sub-frames are regularly split within the frame, the weighted mixing function can in particular be:

$$\hat{h}_w^{(i)}(k,n) = \left(\frac{N-i}{N}\right)\cdot \hat{h}_w(k-1,n) + \left(\frac{i}{N}\right)\cdot \hat{h}_w(k,n) \tag{17}$$

It will be observed that the case in which the filter $\hat{h}_w(k,n)$ is directly applied corresponds to N=1 (no sub-frames).

EXAMPLE 1

This example device is suited to an application to spoken communication, in particular in the preprocessing of a low bit rate speech coder.

Non-overlapping windows are used to reduce to the theoretical maximum the delay introduced by the processing while offering the user the possibility of choosing a window that is suitable for the application. This is possible since the windowing of the input signal of the device is not subject to a perfect reconstruction constraint.

In such an application, the windowing function w(n) applied by the multiplier 2 is advantageously dissymmetric in order to perform a stronger weighting on the more recent half of the frame than on the less recent half.

Figure 4:
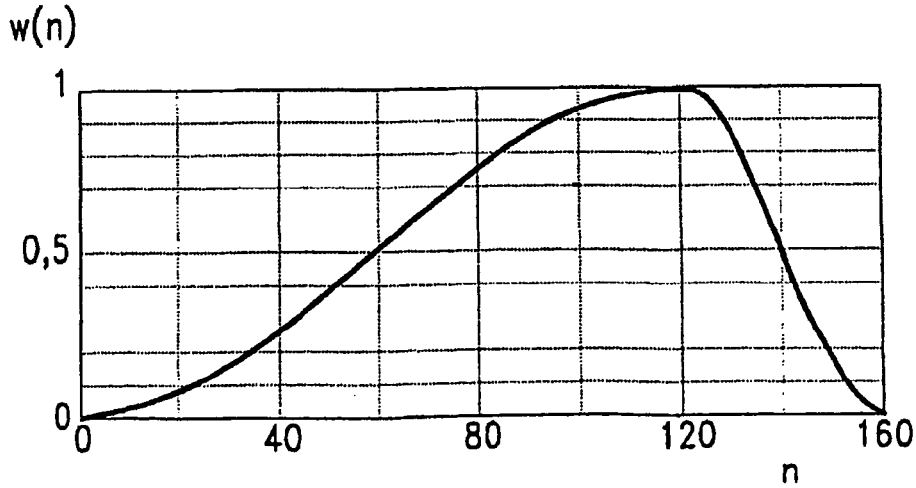
FIG. 4 is a graph of a windowing function that can be used in a particular embodiment of the method.

As illustrated by FIG. 4, the dissymmetric analysis window w(n) can be constructed using two Hanning half-windows of different sizes $L_1$ and $L_2$:

$$w(n) = \begin{cases} 0.5 - 0.5\times\cos\left(\frac{\pi n}{L_1}\right) & \text{for } 0 \le n < L_1 \\ 0.5 + 0.5\times\cos\left(\frac{\pi(n-L_1+1)}{L_2}\right) & \text{for } L_1 \le n < L_1 + L_2 = L \end{cases} \tag{18}$$

Many speech coders for mobiles use frames of length 20 ms and operate at the sampling frequency $F_e$=8 kHz (that is, 160 samples per frame). In the example represented in FIG. 4, the following have been chosen: L=160, $L_1$=120 and $L_2$=40.

The choice of such a window means that the weight of the spectral estimation can be concentrated toward the most recent samples, while ensuring a good spectral window. The method proposed enables such a choice since there is no constraint of perfect reconstruction of the signal at synthesis (signal reconstructed at output by time-domain filtering).

For better frequency resolution, the units 3 and 7 use an FFT of length $L_{FFT}$=256. There is a reason behind this choice also, since the FFT is numerically optimal when it applies to frames whose length is a power of 2. It is therefore necessary to extend in advance the window block $x_w(k,n)$ by $L_{FFT}-L$=96 zero samples ("zero-padding"):

$$x_w(k,n)=0 \text{ for } L \leqq n < L_{FFT} \tag{19}$$

The voice activity detection used in this example is a conventional method based on short-term/long-term energy comparisons in the signal. The estimation of the noise power spectral density $\gamma_{bb}(k,f)$ is updated by exponential smoothing estimation, in accordance with expression (10) with $\alpha(k_b)$=0.8553, corresponding to a time constant of 128 ms, deemed sufficient to ensure a compromise between a reliable estimation and a tracking of the time-domain variations of the noise statistic.

The TF of the noise reduction filter $\hat{H}_1(k,f)$ is pre-estimated in accordance with formula (5) (open loop Wiener filter), after having pre-estimated the PSD of the useful signal according to the directed-decision estimator defined in (12) with $\beta(k)$=0.98. The same function F is reused by the module 16 to produce the final estimation $\hat{H}(k,f)$ of the TF.

Since the TF $\hat{H}(k,f)$ is real-valued TF, the time-domain filter is rendered causal by:

$$\begin{cases} \hat{h}_{caus}(k,n) = \hat{h}(k,n+L/2) & \text{for } 0 \le n < L/2 \\ \hat{h}_{caus}(k,n) = \hat{h}(k,n-L/2) & \text{for } L/2 \le n < L \end{cases} \tag{20}$$

One then selects the $L_{filt}$=21 coefficients of this filter, which is weighted by a Hanning window $w_{filt}(n)$ of length $L_{filt}$, a value corresponding to the significant samples for this application:

$$\hat{h}_w(k,n) = w_{filt}(n)\cdot\hat{h}_{caus}\left(k, n+\frac{L}{2}-\frac{L_{filt}-1}{2}\right) \quad \text{for } 0 \le n < L_{filt} \tag{21}$$

$$\text{where } w_{filt}(n) = 0{,}5 - 0{,}5\cdot\cos\left(\frac{2\pi n}{L_{filt}-1}\right) \quad \text{for } 0 \le n < L_{filt} \tag{22}$$

The time-domain filtering is performed by N=4 filters of sub-frames $$\hat{h}_w^{(i)}(k,n)$$

obtained by the weighted mixing functions given by (17). These four filters are then applied using a transverse filtering of length $L_{filt}$=21 to the four sub-frames of the input signal $x^{(i)}(k,n)$, these sub-frames being obtained by contiguous extraction of four sub-frames of size L/4=40 samples of the observation signal x(k,n):

$$x^{(i)}(k,n)=x(k,n) \text{ for } (i-1).L/N \leqq n < i.L/N \tag{22}$$

EXAMPLE 2

This example device is suited to an application to robust speech recognition (in a noisy environment).

In this example, analysis frames of length L are used which exhibit mutual overlaps of L/2 samples between two successive frames, and the window used is of the Hanning type:

$$w(n) = 0{,}5 - 0{,}5\cdot\cos\left(\frac{2\pi n}{L-1}\right) \quad \text{for } 0 \le n < L \tag{23}$$

The frame length is fixed at 20 ms, that is L=160 at the sampling frequency $F_e$=8 kHz, and the frames are supplemented with 96 zero samples ("zero padding") for the FFT.

In this example, the calculation of the TF of the noise-reducing filter is based on a ratio of square roots of power spectral densities of the noise $\hat{\gamma}_{bb}(k,f)$ and of the useful signal $\hat{\gamma}_{ss}(k,f)$, and consequently on the moduli of the estimate of the noise $$|\hat{B}(k,f)| = \sqrt{\hat{\gamma}_{bb}(k,f)}$$

and of the useful signal $$|\hat{S}(k,f)| = \sqrt{\hat{\gamma}_{ss}(k,f)}.$$

The voice activity detection used in this example is an existing conventional method based on short-term/long-term energy comparisons in the signal. The estimation of the modulus of the noise signal $$|\hat{B}(k,f)| = \sqrt{\hat{\gamma}_{bb}(k,f)}$$

is updated by exponential smoothing estimation:

$$\begin{cases} |\hat{B}(k_b,f)| = \alpha\cdot|\hat{B}(k_b-1,f)| + (1-\alpha)\cdot|x(k_b,f)| \\ |\hat{B}(k,f)| = |\hat{B}(k_b,f)| \end{cases} \tag{24}$$

where $k_b$ is the current noise frame or the last noise frame (if k is detected as useful signal frame). The smoothing quantity a is chosen as constant and equal to 0.99, that is a time constant of 1.6 s.

The TF of the noise reduction filter $\hat{H}_1(k,f)$ is pre-estimated by the module 13 according to:

$$\hat{H}_1(k,f)=F(|\hat{S}(k,f)|, |\hat{B}(k,f)|) \tag{25}$$

where:

$$F(y,z) = \frac{y}{y+z} \tag{26}$$

Calculating a square root enables estimations to be performed on the moduli, which are related to the SNR $\eta(k,f)$ by:

$$\eta(k,f) = \frac{|\hat{S}(k,f)|^2}{|\hat{B}(k,f)|^2} \tag{27}$$

The estimator of the useful signal as modulus $|\hat{S}(k,f)|$ is obtained by:

$$|\hat{S}(k,f)|=\beta.|\hat{S}(k-1,f)|^2+(1-\beta).P[|X(k,f)|-|\hat{B}(k,f)|] \tag{28}$$

where $\beta(k)$=0.98.

The multiplier 14 performs the product of the pre-estimated TF $\hat{H}_1(k,f)$ times the spectrum X(k,f), and the modulus of the result (and not its square) is obtained in 15 to provide the refined estimation of $|\hat{S}(k,f)|$, based on which the module 16 produces the final estimation $\hat{H}(k,f)$ of the TF using the same function F as in (25).

The time-domain response $\hat{h}_w(k,n)$ is then obtained in exactly the same way as in example 1 (transition to the time domain, restitution of the causality, selection of significant samples and windowing). The only difference lies in the choice of the selected number of coefficients $L_{filt}$, which is fixed at $L_{filt}$=17 in this example.

The input frame x(k,n) is filtered by directly applying to it the noise reduction filter time-domain response obtained $\hat{h}_w(k,n)$. Not performing filtering in sub-frames amounts to taking N=1 in expression (17).

The invention claimed is:

1. A method for reducing noise in successive frames of an input signal, comprising the following steps for at least some of the frames:

calculating a spectrum of the input signal by transformation to the frequency domain;

obtaining a frequency-dependent noise level estimator;

calculating a first frequency-dependent useful signal level estimator for the frame;

calculating a transfer function of a first noise-reducing filter on the basis of the first useful signal level estimator and of the noise level estimator;

calculating a second frequency-dependent useful signal level estimator for the frame, by combining the spectrum of the input signal and the transfer function of the first noise-reducing filter;

calculating a transfer function of a second noise-reducing filter on the basis of the second useful signal level estimator and of the noise level estimator; and using the transfer function of the second noise-reducing filter in a frame filtering operation to produce a signal with reduced noise.

2. The method as claimed in claim 1, wherein the calculation of the spectrum comprises weighting the input signal frame by a windowing function and transforming the weighted frame to the frequency domain, the windowing function being dissymmetric so as to apply a stronger weighting on the more recent half of the frame than on the less recent half of the frame.

3. The method as claimed in claim 1, wherein a noise-reducing filter impulse response is determined for the current frame based on a transformation to the time domain of the transfer function of the second noise-reducing filter, and the filtering operation on the frame in the time domain is carried out by means of the impulse response determined for said frame.

4. The method as claimed in claim 3, wherein the determination of the noise-reducing filter impulse response for the current frame comprises the steps of:

transforming to the time domain the transfer function of the second noise-reducing filter to obtain a first impulse response; and truncating the first impulse response to a truncation length corresponding to a number of samples substantially smaller than a number of points of the transformation to the time domain.

5. The method as claimed in claim 4, wherein the determination of the noise-reducing filter impulse response for the current frame further comprises the step of:

weighting the truncated impulse response by a windowing function on a number of samples corresponding to said truncation length.

6. The method as claimed in claim 3, wherein the current frame is subdivided into a plurality of sub-frames and for each sub-frame an interpolated impulse response is calculated based on the noise-reducing filter impulse response determined for the current frame and on the noise-reducing filter impulse response determined for at least one previous frame, and wherein the filtering operation of the frame includes filtering the signal of each sub-frame in the time domain in accordance with the interpolated impulse response calculated for said sub-frame.

7. The method as claimed in claim 6, wherein the interpolated impulse responses are calculated for the various sub-frames of the current frame as weighted sums of the noise-reducing filter impulse response determined for the current frame and of the noise-reducing filter impulse response determined for the previous frame.

8. The method as claimed in claim 7, wherein the interpolated impulse response calculated for the i-th sub-frame of the current frame ($1 \leqq i \leqq N$) is equal to $(N-i)/N$ times the noise-reducing filter impulse response determined for the previous frame plus $i/N$ times the noise-reducing filter impulse response determined for the current frame, N being the number of sub-frames of the current frame.

9. The method as claimed in claim 1, wherein the input signal is an audio signal.

10. A device for reducing noise in an input signal, comprising:

means for calculating a spectrum of a frame of the input signal by transformation to the frequency domain;

means for obtaining a frequency-dependent noise level estimator;

means for calculating a first frequency-dependent useful signal level estimator for the frame;

means for calculating a transfer function of a first noise-reducing filter on the basis of the first useful signal level estimator and of the noise level estimator;

means for calculating a second frequency-dependent useful signal level estimator for the frame, by combining the spectrum of the input signal and the transfer function of the first noise-reducing filter;

means for calculating a transfer function of a second noise-reducing filter on the basis of the second useful signal level estimator and of the noise level estimator; and means for filtering the frame by means of the transfer function of the second noise-reducing filter to produce a signal with reduced noise.

11. The device as claimed in claim 10, wherein the spectrum calculation means comprise means for weighting the input signal frame by a windowing function and means for transforming the weighted frame to the frequency domain, the windowing function being dissymmetric so as to apply a stronger weighting to the more recent half of the frame than to the less recent half of the frame.

12. The device as claimed in claim 10, comprising means for determining a noise-reducing filter impulse response for the current frame based on a transformation to the time domain of the transfer function of the second noise-reducing filter, wherein device the filtering means operate in the time domain by means of the impulse response determined for the current frame.

13. The device as claimed in claim 12, wherein the means for determining the noise-reducing filter impulse response comprise means for transforming to the time domain the transfer function of the second noise-reducing filter, in order to obtain a first impulse response, and means for truncating the first impulse response to a truncation length corresponding to a number of samples substantially smaller than the number of points of the transformation to the time domain.

14. The device as claimed in claim 13, wherein the means for determining the noise-reducing filter impulse response comprise means for weighting the truncated impulse response by a windowing function on a number of samples corresponding to said truncation length.

15. The device as claimed in claim 12, further comprising means for subdividing the current frame into a plurality of sub-frames and means for calculating an interpolated impulse response for each sub-frame based on the noise-reducing filter impulse response determined for the current frame and on the noise-reducing filter impulse response determined for at least one previous frame, wherein the filtering means comprise a filter for filtering the signal of each sub-frame in the time domain in accordance with the interpolated impulse response calculated for said sub-frame.

16. The device as claimed in claim 15, wherein the means for calculating the interpolated impulse response are arranged for calculating the interpolated impulse responses for the various sub-frames of the current frame as weighted sums of the noise-reducing filter impulse response determined for the current frame and of the noise-reducing filter impulse response determined for the previous frame.

17. The device as claimed in claim 16, wherein the interpolated impulse response calculated for the i-th sub-frame of the current frame ($1 \leqq i \leqq N$) is equal to $(N-i)/N$ times the noise-reducing filter impulse response determined for the previous frame plus i/N times the noise-reducing filter impulse response determined for the current frame, N being the number of sub-frames of the current frame.

18. The device as claimed in claim 10, wherein the input signal is an audio signal.

* * * * *